United States Patent [19]

Wellman et al.

[11] Patent Number: 4,687,360

[45] Date of Patent: Aug. 18, 1987

[54] THERMAL IMAGING RIBBON INCLUDING A PARTIALLY CRYSTALLINE POLYMER

[75] Inventors: Russel E. Wellman, Southbury; Phyllis A. Cuming, Naugatuck, both of Conn.

[73] Assignee: Pitney Bowes Inc., Stamford, Conn.

[21] Appl. No.: 818,935

[22] Filed: Jan. 15, 1986

[51] Int. Cl.[4] ..... B41J 31/00

[52] U.S. Cl. ..... 400/241.1; 400/120; 428/913

[58] Field of Search ..... 400/118, 120, 121, 241, 400/241.1, 241.2; 428/913; 346/76 PH, 76 R; 524/762, 831; 106/31, 32

[56] References Cited

U.S. PATENT DOCUMENTS

| | | | |
|---|---|---|---|
| 2,713,822 | 7/1955 | Newman | 346/76 R X |
| 3,744,611 | 7/1973 | Montanari et al. | 400/120 |
| 4,103,066 | 7/1978 | Brooks et al. | 400/118 X |
| 4,128,395 | 12/1978 | Hadfield et al. | 428/913 X |
| 4,251,276 | 2/1981 | Ferree, Jr. et al. | 400/241.2 X |
| 4,268,368 | 5/1981 | Aviram et al. | 400/241.1 X |
| 4,269,892 | 5/1981 | Shattuck et al. | 400/120 X |
| 4,291,994 | 9/1981 | Smith et al. | 400/241.1 |
| 4,320,170 | 3/1982 | Findlay | 400/120 X |
| 4,326,812 | 4/1982 | Pasini et al. | 400/121 |
| 4,327,365 | 4/1982 | Noda | 346/76 PH |
| 4,400,100 | 8/1983 | Aviram et al. | 400/241.1 X |
| 4,600,628 | 7/1986 | Ishii et al. | 428/913 X |

FOREIGN PATENT DOCUMENTS

| | | | |
|---|---|---|---|
| 0164688 | 12/1985 | European Pat. Off. | 400/241.2 |
| 3536340 | 4/1986 | Fed. Rep. of Germany | 400/120 |
| 1000682 | 8/1965 | United Kingdom | 400/241.1 |

*Primary Examiner*—Ernest T. Wright, Jr.

*Attorney, Agent, or Firm*—Peter Vrahotes; David E. Pitchenik; Melvin J. Scolnick

[57] ABSTRACT

A thermal transfer ribbon comprising a substrate and an ink layer is disclosed. The ink layer comprises a partially crystalline polymer which becomes soft at a time when the crystalline portion begins to melt, the polymer derived from an acid containing at least one carboxylic acid moiety.

18 Claims, No Drawings

THERMAL IMAGING RIBBON INCLUDING A PARTIALLY CRYSTALLINE POLYMER

This invention relates to non-impact imaging technology and, more particularly, to a novel thermal transfer ribbon.

BACKGROUND OF THE INVENTION

It is known to form and transfer images by non-impact means. One non-impact technology involves the use of ribbons comprising substrates having coated thereon a solid meltable ink.

Conventional thermal printing over the years has proven itself as one of the major printing technologies, featuring low hardware cost and high reliability. Its major drawback has been the need for special, chemically treated paper. Conventional thermal paper has been greatly improved over the past few years. Yet, such papers remain expensive, less convenient to handle, and less permanent and archival than "plain" papers. In conventional prior art thermal printing, heat is applied to special paper with a chemical coating designed to turn dark at a specified threshold temperature. Heat is used to cause a chemical reaction in the coating of the imaged paper.

The distinguishing feature of thermal transfer printing is that heat is used to cause the transfer of ink onto a receptor surface. Under digital control, the ink transfer is selective so that characters or other programmed patterns are printed.

As described in the prior art literature or performed by the products introduced to date, ink is coated onto an intermediary material such as film, paper or ribbon. A thermal head, in contact with the ink carrier which is in turn in contact with the surface to be printed, generates sufficient heat to cause the ink on the back of the "ink donor material" to transfer to and penetrate the receptor surface. One variation described in the literature, but not yet implemented as a product, is preheating the ink and selectively transferring it from a cylinder.

The ink and substrate are the keys to thermal transfer.

Various known prior art substrates have been used including Mylar, condenser paper, other polyesters and conductive polyurethanes. Of these, two substrates are most commonly used, Mylar and special condenser paper. Mylar is a registered trademark of DuPont. The Mylar ranges in thickness from 3.5 to 6 microns and the special condenser paper ranges in thickness from about 10 to 13 microns. Condenser paper is used in thermal line printers in widths ranging from about 33 to 267 mm. (The low tear strength of the condenser paper precludes its use for narrower ribbons.) Polyester film like Mylar is found in thermal serial printers in common widths of 6.35, 8.0 and 12.7 mm. The length of both condenser paper and polyester film depends upon the space available in the printer or ribbon cassettes.

There are other substrates known to be adapted for use in thermal transfer ribbons. Some of these are described in U.S. Pat. Nos. 4,103,066; 4,269,892; 4,291,994 and 4,320,170. In U.S. Pat. No. 4,103,066 a polycarbonate resin containing conductive carbon black is used as a substrate for a resistive ribbon for thermal transfer printing. In U.S. Pat. No. 4,269,892 a polyester substrate is disclosed containing from about 15% to about 40% by weight of electrically conductive carbon black.

Many polyester resins are known to the art and are commercially available. As examples of useful materials there may be mentioned the Vitel polyesters. Vitel is a trademark of Goodyear Tire and Rubber Company and is of a class of polyesters which are linear saturated resins containing few free hydroxyl units. Examples of such materials are PE207, PE222 and VPE4583A. Mylar 49000 is another polyester which is known to have given good results when used in prior art systems. A commonly used material is Estane 5707-FI, a polyester which has been crosslinked with isocyanate. Estane is a trademark of the B.F. Goodrich Company. The substrate layer of the ribbons of this prior art patent are from about 8 microns to about 35 microns in thickness.

In U.S. Pat. No. 4,291,994 a substrate is disclosed which comprises a mixture of from about 50% to 90% by weight of a polycarbonate with from about 10% to about 50% by weight of a block copolymer of bisphenol A carbonate and dimethyl siloxane with from about 15% to about 40% by weight of electrically conductive carbon black.

In U.S. Pat No. 4,320,170 an electrically conductive substrate is discussed which comprises polyurethane having predominantly only urethane functional groups and an electrically significant amount of conductive carbon black.

In one type thermal transfer process heretofore used the transfer ribbon in addition to the above-described substrates includes a hot melt ink layer. When a current is applied to the ribbon the resistive material from the substrate heats up causing the ink at that point to transfer to the printing surface or receiver paper. Best results in these prior art systems have been obtained when a smooth finish paper is used, such as Xerox 1024 and 4024 papers.

Further, other thermal transfer processes are described in U.S. Pat. Nos. 2,713,822 and 3,744,611. In these prior art processes the hot melt ink layer melts at from about 85° C. to about 90° C. These ink transfer materials have relatively poor smudge resistance and are known to also have a poor rub resistance. In addition, many of the thermal transfer inks do not melt sharply and have other below-discussed deficiencies. Commercially available inks, as discussed in the literature on thermal transfer, are based on a mixture of low melting waxes. By definition, waxes gradually soften as they are heated although many have a crystalline component which melts sharply giving a sudden increase in fluidity. Use of waxes leads to a ribbon or film which requires relatively low energy for transfer but has the deficiencies associated with the softening below the crystalline melting point. These deficiencies may include blocking (i.e., adhesion of the ink to the back side of an adjacent layer), offsetting of the ink to material in contact with it at ambient temperatures and poor resolution or edge acuity in the transferred image. In addition, it is desirable to have available a solid meltable ink that has low energy requirements for transfer and permits non-blocking of the roll of ribbon up to at least 45° C. In addition, it would be desirable to have no offsetting of the ink onto material it comes in contact with such as the substrate side of the ribbon when it is rolled at temperatures up to 45° C. Also, a ribbon providing good image quality when transferred, especially image density, resolution, edge acuity and smudging is needed for present special requirement systems. Most of these desirable characteristics are primarily a function of the hot melt ink used.

SUMMARY OF THE INVENTION

It is therefore an object of this invention to provide a novel thermal transfer ribbon devoid of the above-noted disadvantages.

Another object of this invention is to provide a thermal transfer ribbon that is substantially more flexible than most previously used ribbons.

Still another object of this invention is to provide a thermal transfer ribbon having a novel ink layer that has excellent adhesion properties relative to the Mylar substrate.

Another still further object of this invention is to provide a novel ink layer that permits the use of low transfer energy.

Yet still another object of this invention is to provide a novel ink layer that comprises a semi-crystalline polymer sufficiently tough and flexible to allow non-flaking when coated at the desired thickness.

Still yet another object of this invention is to provide a novel ink layer that comprises a sharp melting semi-crystalline polymer that gives substantially complete transfer and good image quality at a very low energy.

The foregoing objects and others are accomplished by the present invention generally speaking by providing a thermal transfer ink ribbon wherein the ink comprises a partially crystalline polymer which does not become soft until the crystalline portion starts to melt. The polymeric crystalline portion has a melting point substantially below 90° C. and is derived from an acid containing at least one carboxylic acid group. The semi-crystalline polymer used in this invention melts in the range of about 45° C. to about 75° C. Examples of these ink component materials are polycaprolactone and polyesters such as polyhexamethylene sebacate (HMS), polyhexamethylene adipate, polymerized long side chain acrylates and acrylamides such as polydocosyl acrylate and their mixtures or copolymers. Obviously, suitable mixtures of these polymeric materials may be used, if desirable.

Typical polymers that are useful in the thermal transfer ribbon of this invention are (1) polyesters having the general formula: $(—A—(CH_2)_m—)_x$ where A is OO-C—$(CH_2)_n$—COO (n and m need not be equal but both are in the range of 5–10. Terminal groups are either H-A (acid terminated) or $(CH_2)_m$-OH(hydroxyl terminated) depending on polymerization conditions and acid/alcohol ratio or (2) long side chain polyacrylates, methacrylates, or acrylamides such as polydocosyl acrylate. (These are characterized by having as the esterifying moiety (alcohol or amine) one which contains a long, linear (non-branched) alkane chain containing from 12–30 carbon atoms.)

This invention permits attainment of the low transfer energy while avoiding the deficiencies caused by low temperature softening by using a crystalline or partially crystalline polymer which does not become soft until the crystalline portion starts to melt. If the semi-crystalline polymer is sufficiently tough and flexible to provide a good, adherent, and non-flaking coating when coated at the desired thickness, it can be applied directly, for example, as a hot melt coating. However, most prior art materials that have the other desired characteristics (including low viscosity at a temperature close to the crystalline melting point) are not suitable for coating by themselves. Some prior art polyamides could be used in this way but their crystalline melting points are commonly about 90° C. which is higher than desired. It has been shown that other polymers which do not have the required transfer properties can be used to provide the flexible, adherent coating without a major effect on the transfer of the sharp-melting polymer. If the transfer ribbon does not have to withstand significant abrasion, a sharp-melting monomeric material could be used in place of the polymer. However, in general, monomeric materials will abrade too easily even when held in a polymeric matrix since they cannot be well encapsulated and still transfer easily and completely. In the present invention we have used a low molecular weight polyhexamethylene sebacate (HMS) as the preferred semi-crystalline polymer. However, there are many other semi-crystalline polymers which melt in the range of 45° C. to 75° C. and could be used for this application. For Example, polyesters such as polyhexamethylene adipate, polymerized long side chain acrylates and acrylamides (such as polydocosyl acrylate which melts at about 60° C.) and their copolymers and polycaprolactone.

The term "low energy" as used herein means, for example, less than three joules per square cm when a Ricoh thermal head is used. Obviously, different type heads would require varying amounts of low energy.

"Semi-crystalline" or "partially-crystalline" when used in this disclosure shall mean a composition containing significant amounts of an amorphous material but with a melting point essentially determined by the crystalline portion of that composition.

The term "Mylar" or "insulating substrate" or "electrically resistive" shall herein mean a Mylar substrate.

By "low molecular weight" is meant a molecular weight below about 2000.

Thermal printers useful with the ribbon of this invention include that using a Ricoh thermal head or printers of U.S. Pat. No. 4,326,812 or U.S. Pat. No. 4,327,365. One can utilize in the present invention any suitable thermal head such as a Ricoh thermal head or the Kyocera thermal head.

PREFERRED EMBODIMENT OF THIS INVENTION

The following examples illustrate preferred embodiments of this invention:

EXAMPLE I

Sebacic acid and 1,6 hexanediol (5/4 acid/diol mol ratio) were reacted together to form a low molecular weight polyhexamethylene sebacate (hereinafter referred to as HMS). The reactant ratio used would give a mol. wt. between 1000 and 2000 with primarily acid end groups. 120 g. of this product was purified by dissolving the polymer in chloroform and adding, with stirring, several volumes of methanol per volume of solution. After standing for a period of time, a polymer-rich chloroform phase would form in the bottom of the beaker and the supernatant methanol phase was decanted. This purification was repeated three times and then the product was dried and ground. 80 g. of the purified HMS and 15 g. of a dye base (Neptun Red Base 543 from BASF Wyandotte) were reacted in refluxing xylene. This product was precipitated from the xylene by the addition of heptane. The red precipitate phase was dried and used as the dyed HMS in the example below.

EXAMPLE 2

HMS plus a small percentage of Basonyl Red 482 dye were emulsified in hot water containing approximately 6% Triton X-305 as surfactant. On cooling, this dispersion proved to be a reasonably stable latex. This latex was coated onto aluminized Mylar. The coating gave good transfers in a Pitney Bowes Model 8400 facsimile machine. In tests with a Ricoh 400 dot thermal head, it was found that this material gave complete transfer at a very low energy (about 0.272 watts/dot), an energy significantly lower than required by any other material tested.

EXAMPLE 3

7.0 grams of dyed HMS were added to 30.0 ml. of a "high density polyethylene" latex (Chemcor's 2-67A polyemulsion). With stirring, the mixture was heated to 75° C. and then cooled to ambient resulting in a stable latex containing approximately 68% solids with the dyed HMS constituting approximately 46% of the total solids. This latex was hand coated onto 24C Mylar sheet (approximately 6 microns thick) using a #24 wire-wound rod. After drying, the sheet was slit into approximately 3.3 cm. strips. These "thermal transfer ribbons" were non-tacky, gave little or no "pressure-offset" and gave extremely good, sharp images when transferred in a Pitney Bowes Model 8400 facsimile machine. In tests with a 400 dot Ricoh thermal head it was found that a good transfer was obtained with 1 msec. preheat, 2 msec. heating time and 0.35 watts/dot.

Any of the Mylar substrates discussed in the Background of the Invention section of this disclosure may be used with the ink formulation of this invention.

The above examples indicate the use of latex ink formulations containing the HMS solids. This permits ease of coating these ink compositions on the substrates. The use of latex or water-based coatings is desirable since their use minimizes the emission of hydrocarbon or solvent materials during drying and other steps. This minimizes also the economic penalty of lost materials and also has ecological advantages. The ribbon of this invention can be used to image in the following imaging processes: electrothermic thermal transfer printers, color facsimile printers, laser activated units and color plotters.

Additives to the ink formulation of this invention may be used to modify the properties of the formulation, if desired. For example, the polymer can have a dye or pigment or other colorant incorporated with it. Also, it is preferably mixed with polyethylene or other polymers before coating on a Mylar sutstrate to provide a more flexible and adherent coating on the surface of the substrate.

The preferred and optimumly preferred embodiments of the present invention have been described herein and shown in the examples to illustrate the underlying principles of the invention but it is to be understood that numerous modifications and ramifications can be made without departing from the spirit and scope of this invention.

What is claimed is:

1. A thermal transfer ribbon comprising a substrate and an ink layer, said layer comprising a partially crystalline polymer which becomes soft at a time when the crystalline portion begins to melt, said polymer derived from an acid containing at least one carboxylic acid moiety.

2. The thermal transfer ribbon of claim 1 wherein said partially crystalline polymer is a material selected from the group consisting of polycaprolactone, polyhexamethylene adipate, polyhexamethylene sebacate, polymerized long side chain acrylates, polymerized long side chain acrylamides, their copolymers and mixtures thereof.

3. The thermal transfer ribbon of claim 1 wherein said polymer conforms to the general formula:

$$[-A-(CH_2)_m-]$$

where A is $OOC-(CH_2)_n-COO$, n and m are each in the range of from 5–10, and terminal groups selected from H-A (acid terminated) and $(CH_2)_mOH$ (hydroxyl terminated) depending on polymerization conditions and acid/alcohol ratio.

4. The thermal transfer ribbon in claim 1 wherein said polymer is a material selected from the group consisting of long side chain polyacrylates, polymethacrylates, polyacrylamides and mixtures thereof characterized by having as the esterifying moiety (alcohol or amine) one which contains a long, linear (non-branched) alkane chain containing from 12–30 carbon atoms.

5. The thermal transfer ribbon of claim 1 wherein said partially crystalline polymer is polyhexamethylene sebacate.

6. The thermal transfer ribbon of claim 1 wherein said partially crystalline polymer has a molecular weight up to about 2000 and which melts in the range of 45° C. to 75° C.

7. The thermal transfer ribbon of claim 1 wherein said partially crystalline polymer melts at a temperature below about 90° C.

8. A thermal transfer ribbon for use in a non-impact imaging system which comprises a thermal transfer layer and an electrically resistive substrate layer, said thermal transfer layer being coated on said substrate layer and containing a colorant and a partially crystalline polymer which becomes soft at a time when the crystalline portin begins to melt, said polymer derived from an acid having at least one carboxylic acid group, wherein said polymer has said colorant incorporated therein and wherein said polymer is mixed with a polyalkane to provide a flexible adherent coating layer on said substrate layer, said mixture requiring substantially low energy to effect transfer to a receiving surface.

9. The thermal transfer ribbon of claim 8 wherein said partially crystalline polymer is a material selected from the group consisting of polycaprolactone, polyhexamethylene adipate, polyhexamethylene sebacate, polymerized long side chain acrylates, polymerized long side chain acrylamides, their copolymers and mixtures thereof.

10. The thermal transfer ribbon of claim 8 wherein said substrate is made from a Mylar material.

11. The thermal transfer ribbon of claim 8 wherein said partially crystalline polymer is polyhexamethylene sebacate.

12. The thermal transfer ribbon of claim 8 wherein said partially crystalline polymer has a molecular weight up to about 2000 and which melts in the range of 45° C. to 75° C.

13. The thermal transfer ribbon of claim 8 wherein said partially crystalline polymer melts at a temperature below about 90° C.

14. A ribbon for non-impact thermal transfer printing having an electrically insulating substrate and a transfer layer which comprises a coloring material, a partially crystalline polymer and a polyalkane, said partially crystalline polymer obtained by reacting a diol with an acid group, said partially crystalline polymer having a molecular weight below about 2000 and a sharp melting point below about 90° C., said transfer layer requiring relatively low energy for transfer and which does not become soft until the crystalline portion of said partially crystalline polymer begins to melt.

15. The thermal transfer ribbon of claim 14 wherein said partially crystalline polymer is a material selected from the group consisting of polycaprolactone, polyhexamethylene adipate, polyhexamethylene sebacate, polymerized long side chain acrylates, polymerized long side chain acrylamides, their copolymers and mixtures thereof.

16. The thermal transfer ribbon of claim 14 wherein said substrate is made from a Mylar material.

17. The thermal transfer ribbon of claim 14 wherein said partially crystalline polymer is polyhexamethylene sebacate.

18. The thermal transfer ribbon of claim 14 wherein said partially crystalline polymer has a molecular weight up to about 2000 and which melts in the range of 45° C. to 75° C.

* * * * *